US008601697B2

(12) United States Patent
Whittaker

(10) Patent No.: US 8,601,697 B2
(45) Date of Patent: Dec. 10, 2013

(54) CUTTING TOOLS

(75) Inventor: Kenneth Whittaker, Buckinghamshire (GB)

(73) Assignee: Scott Cutters UK Limited, Buckinghamshire (GB)

( * ) Notice: Subject to any disclaimer, the term of this patent is extended or adjusted under 35 U.S.C. 154(b) by 0 days.

(21) Appl. No.: 13/297,190

(22) Filed: Nov. 15, 2011

(65) Prior Publication Data

US 2012/0084985 A1 Apr. 12, 2012

Related U.S. Application Data

(63) Continuation of application No. 12/867,015, filed as application No. PCT/GB2009/000374 on Feb. 10, 2009, now abandoned.

(30) Foreign Application Priority Data

| | | |
|---|---|---|
| Feb. 12, 2008 | (GB) | 0802564.5 |
| Sep. 23, 2008 | (GB) | 0817402.1 |
| Nov. 14, 2008 | (GB) | 0820832.4 |

(51) Int. Cl.
*B26B 27/00* (2006.01)

(52) U.S. Cl.
USPC ..... 30/101; 30/102

(58) Field of Classification Search
USPC ..... 30/102, 101, 94, 92, 95, 91.2
See application file for complete search history.

(56) References Cited

U.S. PATENT DOCUMENTS

| | | | | |
|---|---|---|---|---|
| 2,937,440 | A * | 5/1960 | Kelly | 30/95 |
| 3,335,492 | A * | 8/1967 | Spiro | 30/101 |
| 3,636,629 | A | 1/1972 | Baun | |
| 4,739,554 | A * | 4/1988 | Hytonen | 30/101 |
| 4,831,732 | A | 5/1989 | Garton | |
| 4,845,844 | A | 7/1989 | Allen | |

(Continued)

FOREIGN PATENT DOCUMENTS

| | | |
|---|---|---|
| DE | 197 10 568 A1 | 9/1998 |
| FR | 2 116 634 | 7/1972 |

(Continued)

OTHER PUBLICATIONS

EP Patent Office action dated May 17, 2011 in Application No. 09710331.1, 4 pages.

(Continued)

*Primary Examiner* — Omar Flores Sanchez

(74) *Attorney, Agent, or Firm* — Christie, Parker & Hale, LLP

(57) ABSTRACT

A cutting tool for a pipe of specific diameter comprises a generally cylindrical body 1 defining a central bore 10 extending along an axis. The body is divided into two axially spaced half portions 2A and 2B which together clamp a cutting blade 8 projecting into the bore 10. The body has a progressively narrowing slot 12 extending from its outer circumference to the bore. At the bore 10 the width of the slot 12 is narrower than the diameter of the bore. One side of the slot 12 is flexibly resilient to flex away when a pipe of diameter equal to the bore is pushed along the slot into the bore and to resile when the pipe has entered the bore, urging the pipe against the blade so that subsequent relative rotation between the tool and pipe will cause the pipe to be severed.

12 Claims, 11 Drawing Sheets

(56) References Cited

U.S. PATENT DOCUMENTS

| | | | | |
|---|---|---|---|---|
| 4,852,255 | A | 8/1989 | Hochfeld | |
| 5,099,577 | A * | 3/1992 | Hutt | 30/101 |
| 5,285,576 | A | 2/1994 | Taylor | |
| 5,325,587 | A * | 7/1994 | Steiner et al. | 30/91.2 |
| 5,414,932 | A * | 5/1995 | Azkona | 30/96 |
| 5,943,778 | A | 8/1999 | Alana | |
| 6,345,444 | B1 * | 2/2002 | Gillet et al. | 30/99 |
| 6,886,253 | B2 * | 5/2005 | Chan | 30/1.5 |
| 7,007,391 | B2 | 3/2006 | Stoick et al. | |

FOREIGN PATENT DOCUMENTS

| | | | |
|---|---|---|---|
| GB | 2 288 353 | A | 10/1995 |
| JP | 2000-51549 | A | 2/2000 |
| WO | WO 87/02614 | A1 | 5/1987 |
| WO | WO 90/05610 | | 5/1990 |
| WO | WO 03/033196 | A1 | 4/2003 |

OTHER PUBLICATIONS

UK Patent Office action dated Dec. 20, 2011 in Application No. GB0802564.5, 4 pages.

International Search Report dated May 15, 2009 for PCT/GB2009/000374.

International Preliminary Report on Patentability issued Aug. 17, 2010 in corresponding application No. PCT/GB2009/000374.

Search Report dated Jul. 1, 2008 for priority United Kingdom application No. GB 0802564.5.

* cited by examiner

CUTTING TOOLS

CROSS-REFERENCE TO RELATED APPLICATION(S)

This application is continuation of U.S. application Ser. No. 12/867,015 filed on Aug. 10, 2010, which is a National Phase Patent Application of International Application Number PCT/GB2009/00374 filed on Feb. 10, 2009, which claims priority to British Patent Application Numbers 0802564.5 filed Feb. 12, 2008, 0817402.1 filed Sep. 23, 2008, and 0820832.4 filed Nov. 14, 2008, the entire contents of which are incorporated herein by reference.

FIELD OF THE INVENTION

The present invention relates to cutting tools, in particular but not exclusively, for cutting tubular conduits or pipes.

BACKGROUND

Plumbing systems have conventionally used copper piping to feed water in water and central heating systems. Copper having become expensive, pipes of plastics material are increasingly used.

Cutting tools for cutting piping have hitherto involved a metallic support carrying a pair of spaced rollers for supporting the pipe to be cut. The support also carries a rotatably supported cutting disc for engaging the side of the pipe opposite that carried by the rollers. A screw mechanism allows the disc to be progressively advanced towards the rollers and into engagement with the pipe. Rotation of the tool about the pipe will create a circular score line in the pipe. An incremental advance of the disc will allow it to bite deeper into the pipe so that on rotation the whole score line is deepened. The process of incrementally advancing the disc and rotating the tool will eventually result in the total severance of the pipe into two lengths.

SUMMARY

The tool is relatively expensive and its operation somewhat tedious. Also, when used with pipes of plastics, the pressure exerted by the tool can cause deformation of the pipe.

It is an object of the present invention to provide an improved cutting tool.

According to the present invention there is provided a tool for cutting a cylindrical conduit having a predetermined external diameter, said tool comprising a body having a bore of a diameter substantially equal to said predetermined diameter and extending along a predetermined axis through the body, a slot extending from an external surface of the body to the bore in the general direction of a first plane containing said axis, said slot tapering so that its width progressively diminishes with distance from the external surface of the body to the external circumference of said bore, said width at said external surface of the body exceeding said predetermined diameter, and at said bore being smaller than said predetermined diameter, a cutting blade extending into said bore along a plane extending at right angles to said predetermined axis by an amount exceeding the thickness of the wall of said conduit, the body having a first portion on one side of the slot which is generally rigid and inflexible and a second portion on the other side of the slot which is resilient and flexible whereby the progressive insertion of a conduit into the bore along the slot will cause the second portion initially to flex away from the first portion until the conduit enters the bore where after the first portion will resile and urge the conduit against the blade, so that relative rotation between the tool and conduit about the predetermined axis will result in the severing of the conduit.

BRIEF DESCRIPTION OF THE DRAWINGS

A cutting tool embodying the present invention, will now be described, by way of example, with reference to the accompanying diagrammatic drawings, in which.

DETAILED DESCRIPTION

Figure 1:
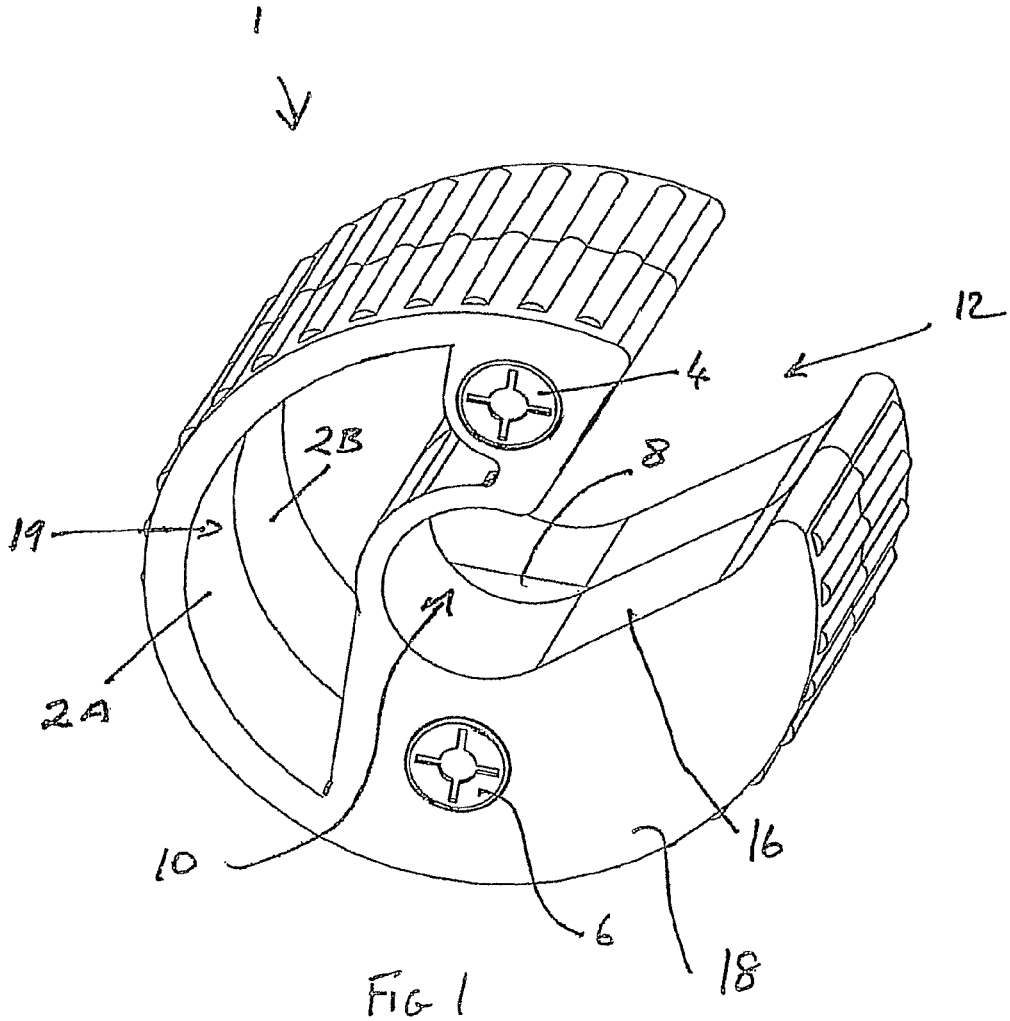
FIG. 1 is a perspective view of a first embodiment of the tool.

The tool of FIG. 1 comprises a generally cylindrical body 1 having two similar half portions 2A and 2B, each being generally cylindrical, lying side by side along a common axis, and being bolted together with a pair of bolts 4 and 6 at diametrically opposite positions. Each half portion 2A and 2B has a central bore or cylindrical opening 10 having substantially the same diameter as the outer diameter of the plastics pipe, it is intended to sever. Sandwiched between the two half portions 2A and 2B is a metal cutting blade 8 having a cutting edge which extends into the bore 10 by an amount exceeding the thickness of the pipe that it is intended to cut.

Each half portion 2A, 2B has a radially inwardly extending slot 12 which extends from the outer circumference of the portion to the outer circumference of the bore 10. The slot 12 is tapered and reduces in width with distance from the outer circumference of the portion towards the bore 10. The width of the slot 12 at the outer circumference is larger than the outer diameter of the pipe to be cut by preferably up to 10% and at the outer circumference of the bore the width of the slot is smaller than the diameter of the pipe to be cut by, advantageously, at least 10% but preferably by at least 5% sufficient to retain the pipe during cutting.

While the slot 12 extends generally radially inwardly, one side wall 16 has at least a portion adjacent the point at which it joins the bore 10, that is tangential to the bore 10 at that point. The segment 18 of the portion 2A (hereinafter referred to as 'the first segment') that is in part defined by the side wall 16, is solid and is generally inflexible. The remaining segments 19 of the portion 2A (hereinafter referred to as 'the second segment') is hollow and has a relatively thin outer wall 20 and a relatively thin radially inwardly displaced inner wall 22. This allows the distal end of the second segment 19 to flex away from the distal end of the first segment 18 and resile under its inherent resilience back again.

The opposite side wall 26, of the slot 12 to the side 16, extends generally radially inwardly to intersect the bore 10 substantially at right angles to its circumference and so forms a nose 30 at the junction of the slot and bore that faces the side wall 16. When the tool is in a relaxed state, the nose 30 is spaced from the side wall by a distance less than the diameter of a pipe to be cut. However, when a pipe is placed on the side wall 16 and displaced inwardly along the side, it will engage the nose 30 and through flexture of the inner and outer walls 20 and 22, will be displaced away from the side wall 16 until the pipe passes into the bore at which point the nose will snap back towards its relaxed state to hold the pipe captive in the bore 10.

When the pipe initially engages the bore 10, it initially engages the blade and so is held from being fully accommodated in the bore 10. The nose 30 will at this point still be acting under the resilience of the walls 20 and 22 to urge the pipe against the blade. Any rotation of the tool relative to the pipe will cause the blade to progressively score the pipe under the pressure applied by the nose until the blade has cut through the wall of pipe whereupon the pipe is fully accommodated within the bore but is severed into two parts.

Depending upon the flexibility and resilience of the material used for the two portions 2A and 2B, the nose 30 may be profiled to have a greater or lesser prominence.

The operation of the tool can be more completely and clearly seen from FIGS. 3*a* to 3*e*.

Figure 3A:
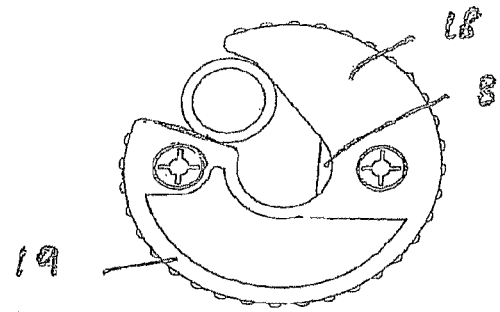
FIGS. 3*a* to 3*e* are a series of views of the tool of FIG. 1 in different operative positions.
Figure 3B:
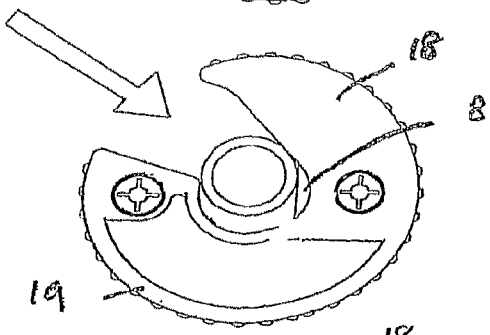
Figure 3C:
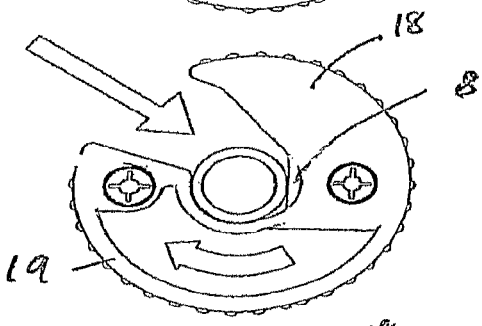
Figure 3D:
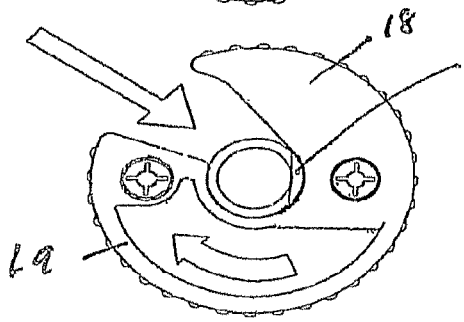
Figure 3E:
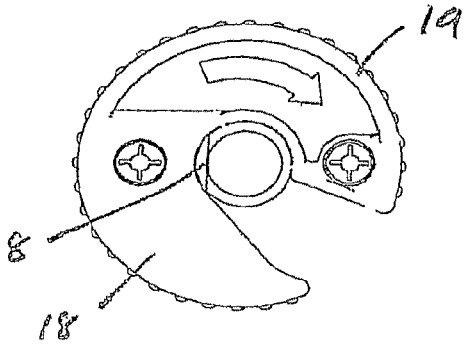

As shown in FIG. 3*a*, the pipe is caused to enter the slot 12. By pushing the pipe into the slot, it displaces the nose 30 and engages the blade 8. Further displacement of the pipe along the blade 8 causes further flexure of the nose 30 away from the blade 8 until the pipe is snugly engaged in that part of the bore 10 defined by the second segment 19 (see FIG. 3*c*). The pressure on the pipe exerted by nose 30 will now cause the blade to enter the pipe locally (see FIG. 3*d*). Rotation of the tool about the pipe will cause the blade to sever the pipe progressively along its circumference (see FIG. 3*e*). Depending upon the thickness of the pipe, the tool may need to be turned about the pipe several times to ensure complete severing of the pipe.

Figure 2:
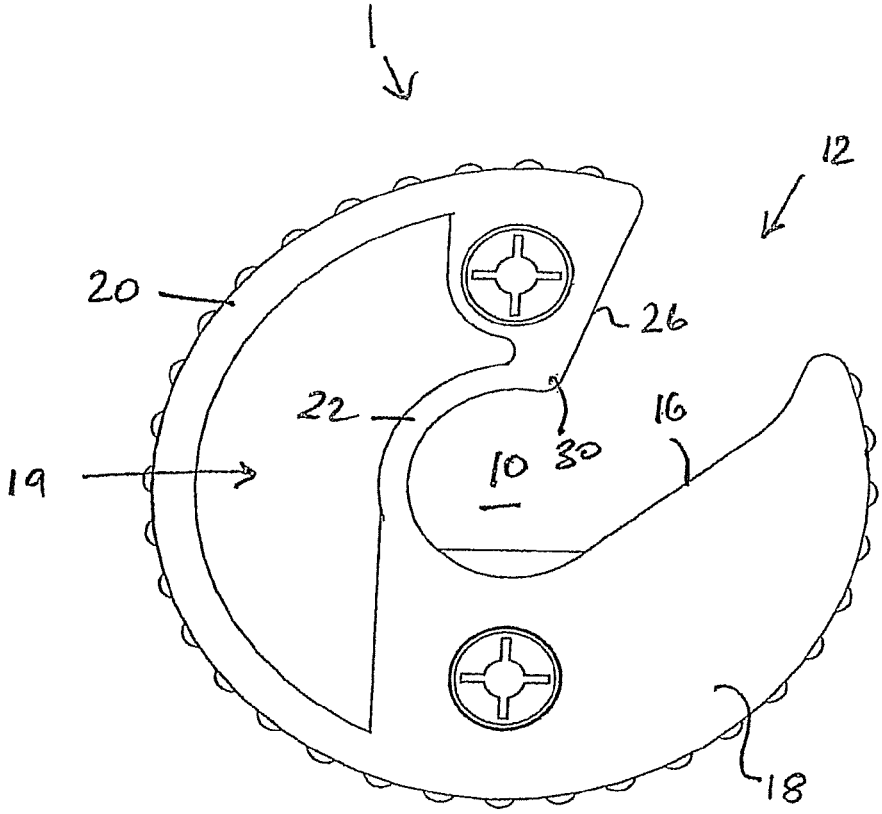
FIG. 2 is a front elevation of the tool of FIG. 1.
Figure 4:
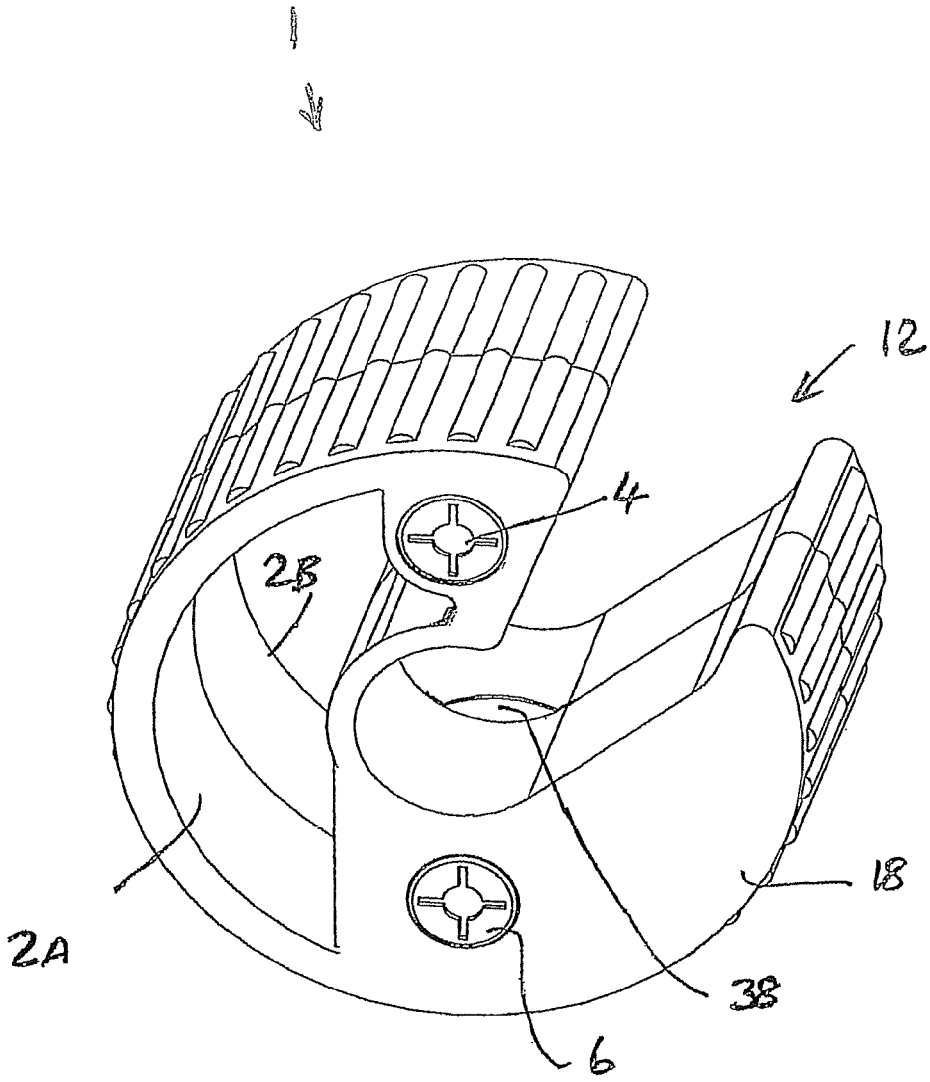
FIG. 4 is a perspective view of a second embodiment of the tool.
Figure 5:
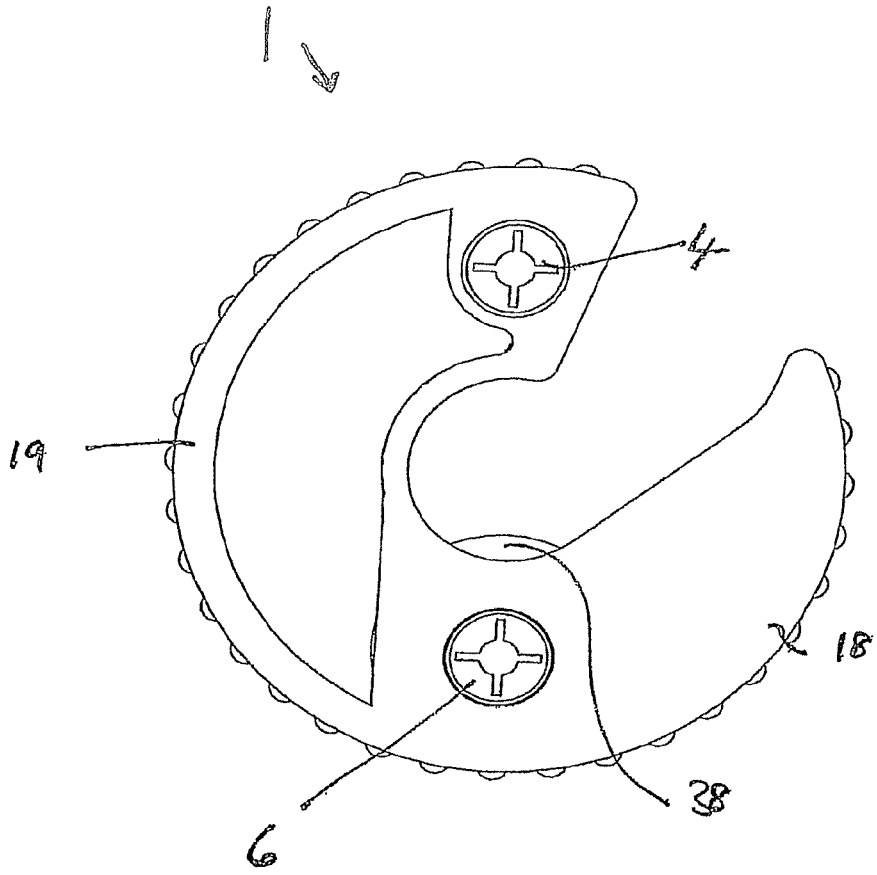
FIG. 5 is a front elevation of the tool of FIG. 4.

In the second embodiment shown in FIGS. 4 and 5, parts similar to those in FIGS. 1 and 2 are similarly referenced. The main difference in this embodiment is that the fixed blade 8 of FIGS. 1 and 2 is replaced by a circular blade 38 which is rotatably supported by the portion 2A and 2B.

Using a specially hardened rotary blade 38 enables the tool to cut more demanding materials such as pipes made of copper.

Instead of a rotary circular blade, a fixed blade having an arcuate profile in the slot similar to that of the rotary blade may be used.

It will be appreciated that while the tool is of a generally cylindrical configuration, it can have other profiles such as ovaloid or cubic.

It will be appreciated that the tool described is intended to cut one size of pipe only. Different sized tools are needed to cut other sizes of pipe.

The body has a knurled outer surface to ease gripping.

The body is preferably made of nylon or other suitable resilient plastic.

With the tools of FIGS. 1 and 2 the cutting blades 8 and 38 are exposed and liable to cut the finger of any operator who injudiciously places his finger into the slot 12. To avoid this danger, a keep cylinder 40 is provided to be located in the slot 8 or 38 to cover the blade when the tool is not being used.

Figure 6:
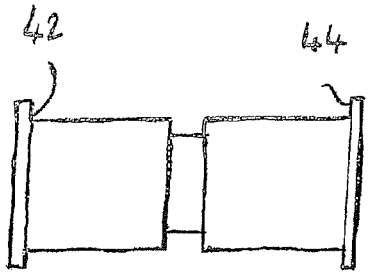
FIGS. 6 and 7 are respectively a front elevation and an axial section through a keep cylinder for the tool.
Figure 7:
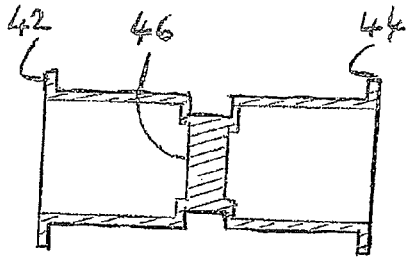

As shown in FIGS. 6 and 7, the keep cylinder comprises a cylinder body having radially outwardly extending flanges 42 and 44 at opposite ends and a grooved central section 46 midway between the flanges 42 and 44. The cylinder body is sized to be accommodated within the bore 10 with the flanges 42 and 44 abutting opposite sides of the tool to lock the keep cylinder against axial movement relative to the tool. The groove is of sufficient depth to accommodate the cutting blade 8 or 3. While the keep cylinder is generally hollow, the portion 46 forming the base of the groove is solid to provide rigidity. The keep cylinder is advantageously of soft flexible plastics.

Figure 8:
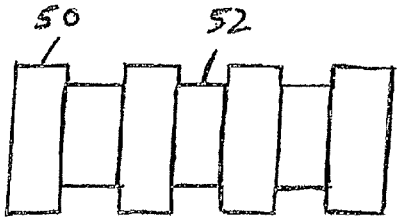
FIGS. 8 and 9 are respectively a front elevation and an axial section through a corrugated conduit.
Figure 9:
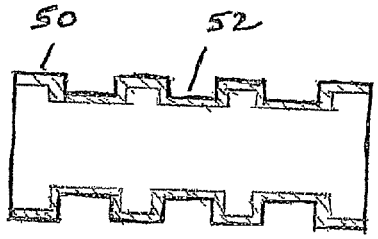
Figure 10:
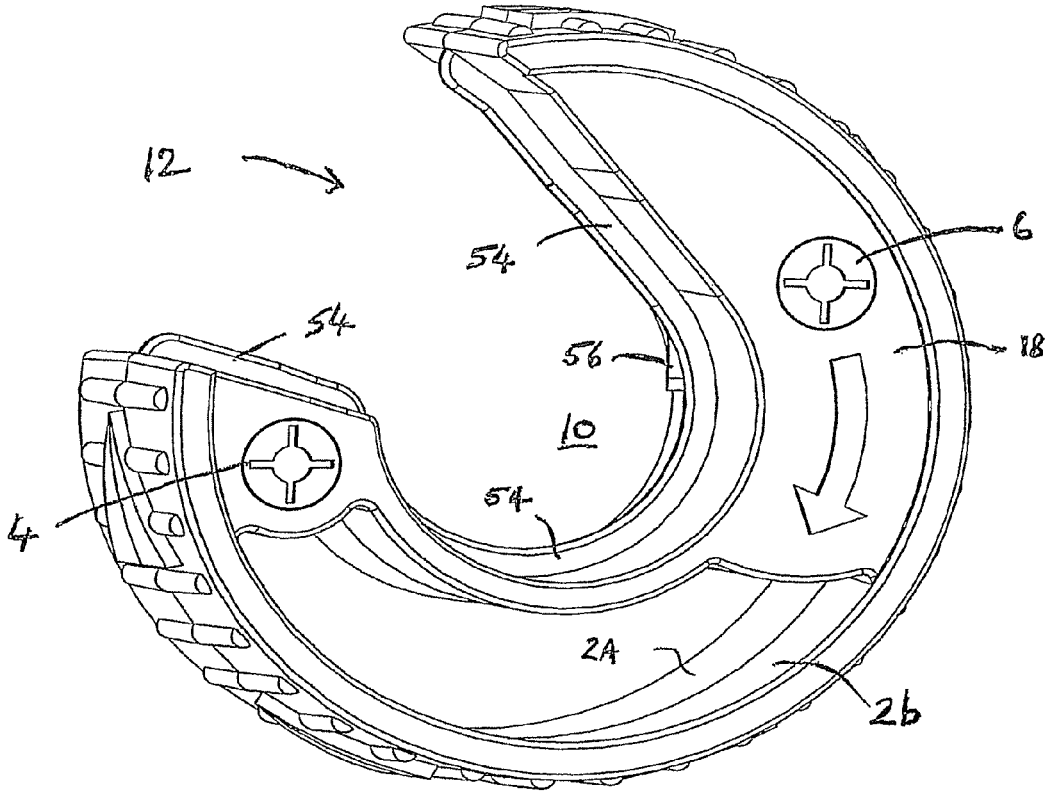
FIG. 10 is a perspective view of a third embodiment of the tool for cutting the conduit of FIGS. 8 and 9.
Figure 11:
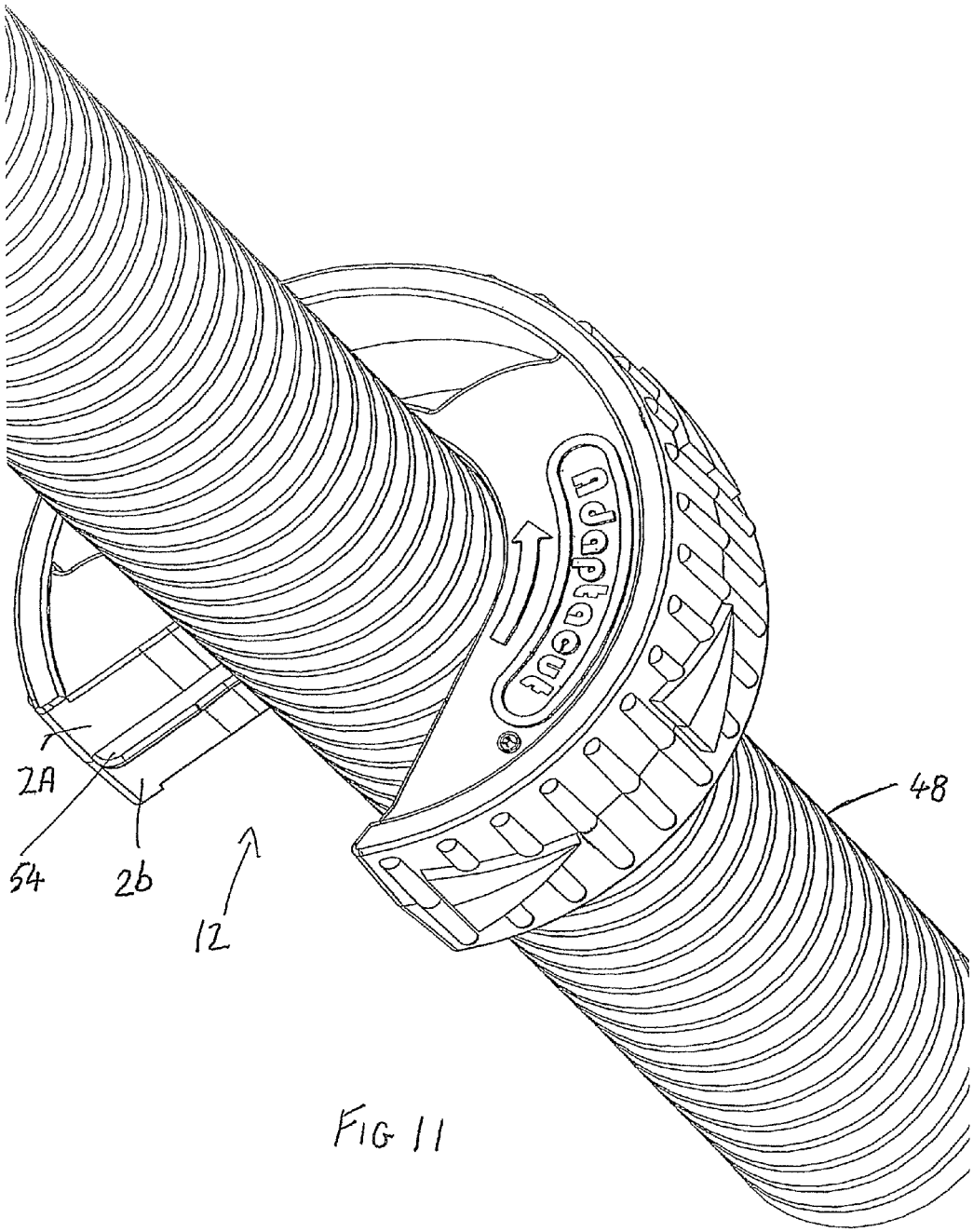
FIG. 11 is a perspective view of the tool of FIG. 10 when engaged by the conduit of FIGS. 8 and 9.

In the third embodiment, shown in FIGS. 10 and 11, parts similar to those in FIG. 1 are similarly referenced. This tool is designed to cut so-called corrugated pipes of the type shown in FIGS. 8 and 9.

As shown, such pipes 48 consist of a series of axially spaced peaks 50 and troughs 52 to allow the pipe to be bent, concertina fashion, away from its central axis so that the pipe can follow an arcuate path.

Such pipes need to be cut to length by severing the pipe at right angles to their central axis either in a trough or on a peak. In order to ensure that the cutting blade of the tool is aligned with the desired cutting position, the tool is provided with a radially inwardly extending rib 54 which extends along one side of the slot 12 around the bore 10 and then along the other side of the slot 12. Embedded in and standing proud of the rib is a cutting blade 56.

In operation, the corrugated pipe is inserted into the tool by causing the portions of the rib 54 on opposite sides of the slot to engage the trough located where the pipe is to be cut. Then pressing the pipe to be cut into the bore will cause the cutting blade 56 to engage the pipe. Relative rotation of the pipe against the blade will produce a circular cut around the pipe. Multiple ribs may serve the same purpose. The blade in this embodiment is situated in the centre of a rib but may be located to either side of the guide rib or ribs.

The portion of the cutting blade 56, which projects from the rib 54, may be straight or triangular in profile with the exposed sides of the triangle, one or each, defining a cutting edge. One cutting edge may extend generally radially of the bore while the other cutting edge may extend generally circumferentially at the bore. The two edges extend generally at right angles to each other.

Figure 12:
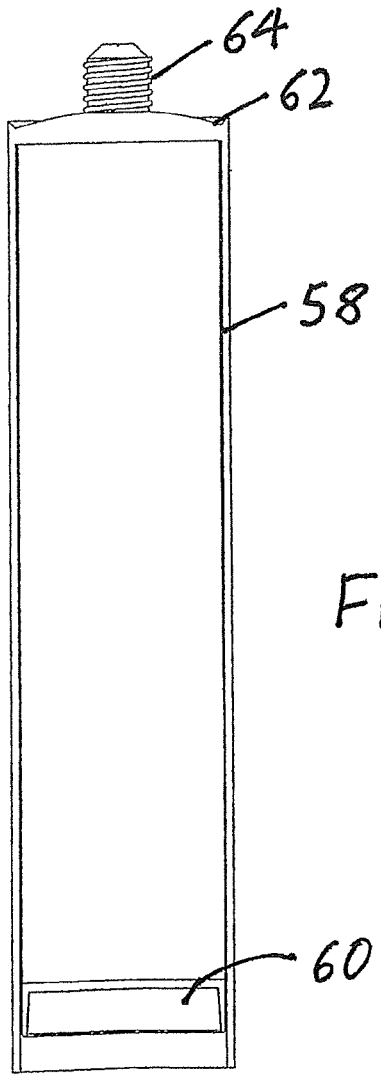

Various flowable and semiflowable materials, particularly in the building trade are traditionally marketed in sealed cartridges. Such cartridges as shown in FIG. 12 generally take the form of a cylindrical body 58 containing a displaceable piston 60 at one end and have a dispensing cap 62 at the opposite end with the material to be dispensed sandwiched in between.

The cap 62 supports an outwardly projecting dispensing tube 64 which is externally screw threaded and sealed at its distal end. A dispensing nozzle 66 (see FIG. 13) is provided to be screw threadedly mounted on the dispensing tube 64.

The nozzle 66 has a cylindrical end portion 68 with an internal screw thread adapted to screw threadedly engage the tube 64 of the cap 62 and a tapered portion 70 extending away from the cylindrical end portion 68 so that both internal and external diameters progressively reduce with distance from the cylindrical end portion 68. The distal end of the tapered portion may be open or sealed.

To make the cartridge ready for use the end of the dispensing tube needs to be severed at right angles to its axis to release the material within the body 58. Also the tapered portion 70 of the nozzle 66 needs to be severed to provide the appropriate size of dispensing orifice from the nozzle. The nozzle is preferably severed along a plane included to the axis of the nozzle to provide a guide surface to guide the direction in which the material is dispensed.

The tools described in FIGS. 1 to 5 are particularly suitable for serving the end of the dispensing tube.

However frequently cartridges of the type described come in two sizes each having a dispensing tube of different diameters.

Figure 14:
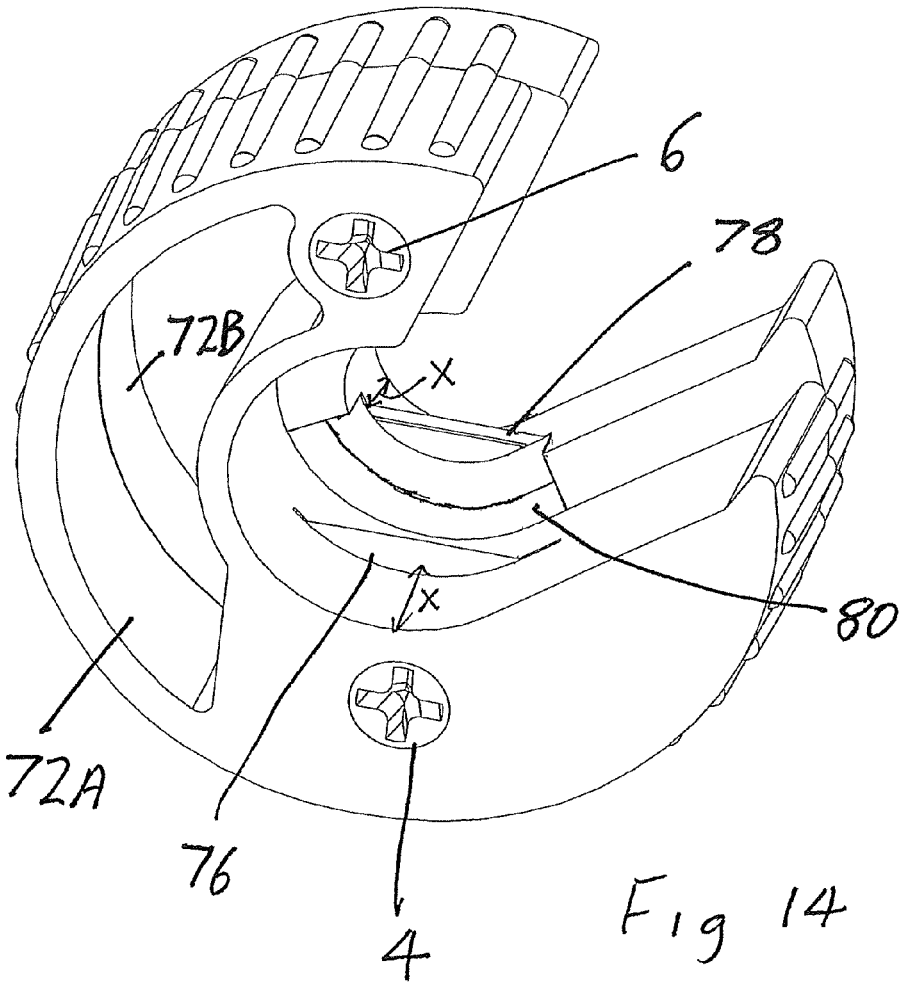
FIG. 14 is a perspective view of a fourth embodiment of the invention.

The tool shown in FIG. 14 can deal with this problem. As with the tool in FIG. 1 the tool consists of two half portions 72A and 72B lying side by side along a common axis and being bolted together along the common axis with a pair of bolts 4 and 6 at substantially diametrically appropriate positions. While the portions 72A and 72B are generally similar in profile to the portions 2A and 2B of FIG. 1 they differ in three major respects. Firstly they have different sized bores and slots with each half portion being sized to accommodate a respective one of two differently sized dispensing tubes. Secondly instead of a single cutting blade being sandwiched between the two half portions, each half portion 72A and 72B carries its own blade 76, 78 embedded therein at a location between opposite axial ends. Thirdly the portion 72B having the smaller bore is provided with a well or recess 80 extending between the blade 78 and the adjacent portion 72A and sized to receive the end portion of the dispensing tube having the larger outer diameter. The severing of the dispensing tubes is carried out in the same manner as described in connection with the tool of FIG. 1 with the exception that different ends of the tube are used for differently sized cartridges.

The two blades 76 and 78 are preferably spaced equidistantly from outer end faces of the tool.

Figure 13:
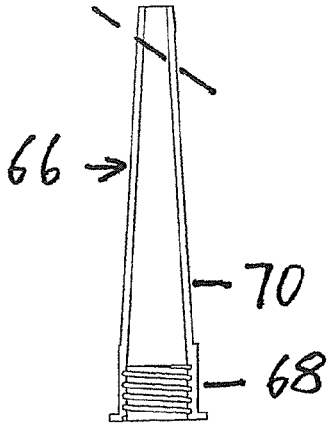
FIGS. 12 and 13 are respectively front elevation views of a dispensing container and nozzle therefor.
Figure 15:
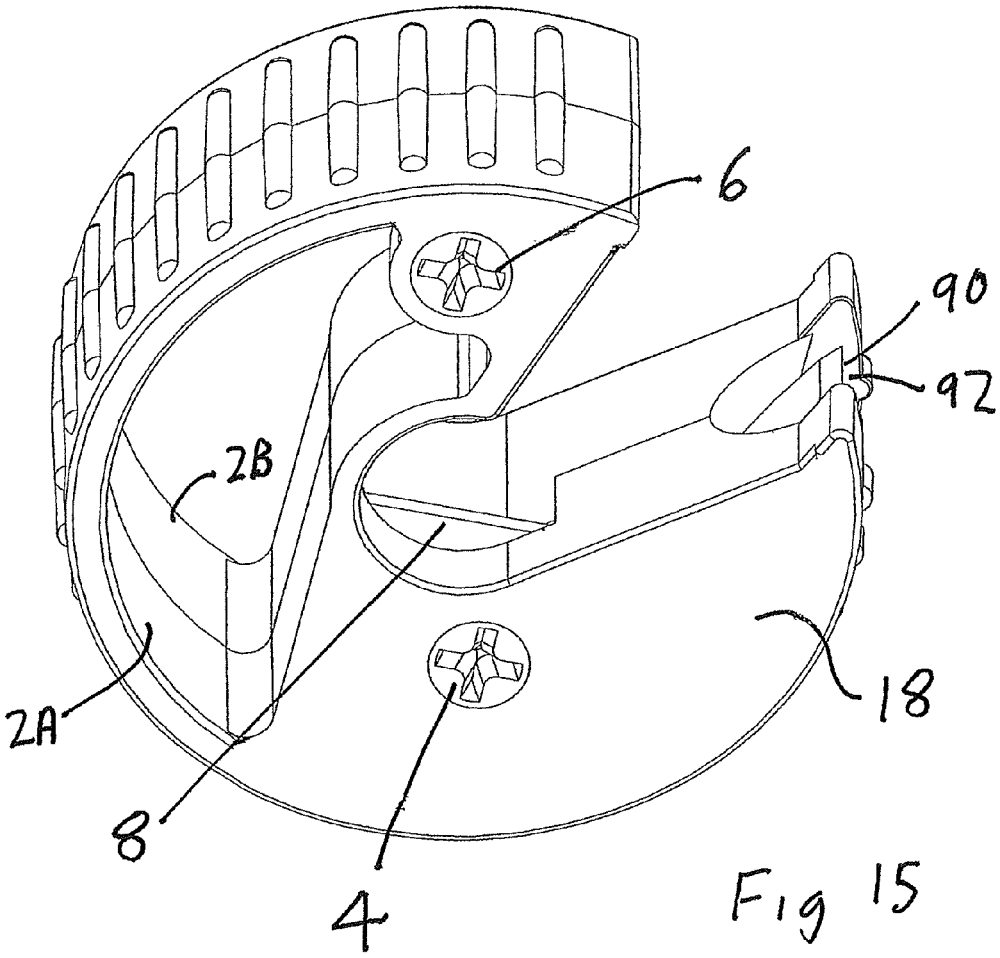
FIG. 15 is a perspective view of a fifth embodiment of the invention.

FIG. 15 shows the tool of FIGS. 1 to 3 modified to incorporate a secondary cutting blade for severing the nozzle of FIG. 13.

As shown parts similar to those in FIGS. 1 to 3 are similarly referenced. The adjoining faces of the two part segments 18 of the two portions 2A and 2B are recessed to define a channel 92 sized to accommodate tapered portion 70 the nozzle 66. The secondary cutting blade is mounted to extend across the channel to lie in a plane extending through the axis, or parallel to the axis, of the tool. In operation the nozzle is placed in the channel and drawn along the channel to cause the blade to sever the end of the tapered portion at an appropriate angle.

It will be appreciated that the secondary blade 90 can also be incorporated into the other embodiments of the tool described herein.

The recessed location of the secondary blade in a channel provides a degree of protection against the blade harming the user.

What is claimed is:

1. A tool for cutting a cylindrical conduit having a predetermined external diameter, said tool comprising a body having a bore of a diameter substantially equal to said predetermined diameter and extending along a predetermined axis through the body, a slot extending from an external surface of the body to the bore in the general direction of a first plane containing said axis, said slot tapering so that its width progressively diminishes with distance from the external surface of the body to the external circumference of said bore, said width at said external surface of the body exceeding said predetermined diameter, and at said bore being smaller than said predetermined diameter, a cutting blade extending into said bore along a plane extending at right angles to said predetermined axis by an amount exceeding the thickness of the wall of said conduit, the body being generally cylindrical about the predetermined axis and adapted to be gripped by the user in rotating the tool, the generally cylindrical body formed by a first segment on one side of the slot which is generally rigid and inflexible and a second segment on the other side of the slot which is resilient and flexible whereby the progressive insertion of a conduit into the bore along the slot will cause the second segment initially to flex away from the first segment until the conduit enters the bore where after the second segment will resile and urge the conduit against the blade, so that relative rotation between the tool and conduit about the predetermined axis will result in the severing of the conduit and wherein said second segment is made of the same material as said first segment but is hollow so as to define radially inner and outer walls sufficiently thin to provide the necessary flexibility and resilience with the inner wall of the second segment defining a portion of the bore and the outer wall of the second segment defining a portion of the generally cylindrical body.

2. A tool according to claim 1, wherein the cutting edge of said blade, which is in said bore, is linear.

3. A tool according to claim 1, wherein the cutting edge of said blade, which is in said bore, is arcuate.

4. A tool according to claim 1, wherein said body comprises two axially spaced halves which sandwich said blade between them.

5. A tool according to claim 1, wherein the width of said slot at said bore is at least 5% smaller than said predetermined diameter when the second portion is in its relaxed state.

6. A tool according to claim 1, wherein when the second portion is in its relaxed state, the width of the slot at said bore is at least 10% smaller than said predetermined diameter.

7. A tool according to claim 1, wherein one side wall of said slot has a surface adjacent said bore which is substantially tangential to the bore.

8. A tool according to claim 7, wherein the other side wall of the slot has a surface which extends substantially radially of the slot.

9. A tool for cutting a cylindrical corrugated conduit having a predetermined external diameter defining a plurality of axially spaced peaks and troughs, said tool comprising a body having a bore of a diameter substantially equal to said predetermined diameter and extending along a predetermined axis through the body, a slot extending from an external surface of the body to the bore in the general direction of a first plane containing said axis, said slot tapering so that its width progressively diminishes with distance from the external surface of the body to the external circumference of said bore, said width at said external surface of the body exceeding said predetermined diameter, and at said bore being smaller than said predetermined diameter, a cutting blade extending into said bore along a plane extending at right angles to said predetermined axis by an amount exceeding the thickness of the wall of said conduit, the body having a first segment on one side of the slot which is generally rigid and inflexible and a second segment on the other side of the slot which is resilient and flexible whereby the progressive insertion of a conduit into the bore along the slot will cause the second segment initially to flex away from the first segment until the conduit enters the bore where after the second segment will resile and urge the conduit against the blade, so that relative rotation between the tool and conduit about the predetermined axis will result in the severing of the conduit and wherein said tool includes a rib or ribs projecting inwardly generally at right angles to said predetermined axis, said rib extending around all or part of said bore and along opposite faces of said slot and sized to engage a said trough or troughs of the conduit, the rib locating said cutting blade to engage and cut said conduit around its diameter.

10. A tool according to claim 9, wherein said blade has a triangular portion projecting from said rib providing two edges extending at right angles to each other.

11. A tool according to claim 10, wherein one side edge of the triangular portion extends radially of said base and defines a cutting edge.

12. A tool according claim 1, including a keep cylinder comprising a cylindrical body arranged to engage said bore, said cylindrical body having a central groove to accommodate said cutting blade, and flanges at opposite ends to engage opposite end faces of the tool to inhibit axial displacement of the cylindrical body relative to the tool.

* * * * *